US008876646B2

(12) United States Patent
Gasser

(10) Patent No.: US 8,876,646 B2
(45) Date of Patent: Nov. 4, 2014

(54) DRIVE FOR A MOVABLE FURNITURE PART

(75) Inventor: Ingo Gasser, Höchst (AT)

(73) Assignee: Julius Blum GmbH, Hoechst (AT)

( * ) Notice: Subject to any disclaimer, the term of this patent is extended or adjusted under 35 U.S.C. 154(b) by 1410 days.

(21) Appl. No.: 12/603,796

(22) Filed: Oct. 22, 2009

(65) Prior Publication Data

US 2010/0037715 A1 Feb. 18, 2010

Related U.S. Application Data

(63) Continuation of application No. PCT/AT2008/000056, filed on Feb. 22, 2008.

(30) Foreign Application Priority Data

Apr. 23, 2007 (AT) ..... A 629/2007

(51) Int. Cl.
*F16H 48/06* (2006.01)
*A47B 88/04* (2006.01)

(52) U.S. Cl.
CPC ..... *A47B 88/0477* (2013.01)
USPC ..... 475/149

(58) Field of Classification Search
None
See application file for complete search history.

(56) References Cited

U.S. PATENT DOCUMENTS

| | | | | |
|---|---|---|---|---|
| 2,873,159 | A | 2/1959 | Becker | |
| 6,371,584 | B1 | 4/2002 | Alreck | |
| 6,409,622 | B1 * | 6/2002 | Bolz et al. | 475/5 |
| 7,780,251 | B2 * | 8/2010 | Dubach et al. | 312/319.7 |
| 8,344,670 | B2 * | 1/2013 | Gassner | 318/255 |
| 2007/0180654 | A1 | 8/2007 | Gasser | |
| 2008/0290774 | A1 * | 11/2008 | Gasser et al. | 312/330.1 |

FOREIGN PATENT DOCUMENTS

| | | |
|---|---|---|
| AT | 203662 | 5/1959 |
| AT | 413 472 | 3/2006 |
| DE | 20 2007 008 561 | 8/2007 |
| WO | 2004/023933 | 3/2004 |
| WO | 2004/100718 | 11/2004 |
| WO | 2006/017864 | 2/2006 |
| WO | 2006/017865 | 2/2006 |
| WO | 2007/006061 | 1/2007 |

OTHER PUBLICATIONS

International Search Report issued Jun. 11, 2008 in International (PCT) Application No. PCT/AT2008/000056.

Austrian Patent Office issued Oct. 15, 2007 in Austrian Application No. A 629/2007.

* cited by examiner

*Primary Examiner* — Robert A Siconolfi

*Assistant Examiner* — Huan Le

(74) *Attorney, Agent, or Firm* — Wenderoth, Lind & Ponack, L.L.P.

(57) ABSTRACT

A movable furniture part, such as a furniture drawer, includes an ejector device having an ejector lever and an electric motor for driving the ejector lever. A retracting device has a pulling member that can be wound onto a roll. The roll can be driven by an electric motor, and the ejector device and retracting device are mechanically connected to one another such that they can be mounted as a unit in or on a furniture body.

13 Claims, 7 Drawing Sheets

DRIVE FOR A MOVABLE FURNITURE PART

This application is a Continuation of International application No. PCT/AT2008/000056, filed Feb. 22, 2008.

BACKGROUND OF THE INVENTION

The present invention concerns a drive for a movable furniture part, in particular a furniture drawer, comprising an ejection device having an ejection lever and an electric motor for driving the ejection lever.

By virtue of such a drive, it is possible to eject the movable furniture part from its closed end position in or on a furniture body or carcass, into an at least partially open position. It is however not possible to move the movable furniture part in an opposite relationship to the opening direction in order, for example, to transfer it into the closed end position.

The object of the invention is to develop a drive of the general kind set forth, in such a way that its functionality is enhanced but the drive is not more complicated and expensive to fit.

SUMMARY OF THE INVENTION

The provision of a retraction device allows the application of forces to the movable furniture part in the retraction direction. A cable line, for example, presents itself as a pulling means. It is however also possible to provide pulling means having a certain stiffness (such as for example metal bands).

The mechanical connection of the ejection device and the retraction device to afford a structural unit ensures that the drive with the combined functionalities is equally simple to fit as a drive in accordance with the state of the art, which has only an ejection device.

For example, the ejection device and the retraction device are arranged on a common mounting plate. A particularly preferred embodiment of the invention, however, is one in which the ejection device and the retraction device are arranged in a common housing.

It is particularly advantageous if the housing has a stirrup arrestable by a lever for fastening the drive to a profile bar without a tool. That permits particularly simple mounting of the drive.

In principle, a drive according to the invention can have an electric motor assembly with respective dedicated electric motors for the ejection device and the retraction device.

In that case, it is desirable if the ejection device and the retraction device have respective dedicated transmissions for the transmission of force from the respective electric motor to the ejection lever and the roller respectively so that the drive train of the ejection device and that of the retraction device remain mechanically separated from each other.

In such a case, coupling of the ejection device and the retraction device can be effected electronically by a common control or regulating unit.

Alternatively, it can be provided that the ejection lever of the ejection device and the roller of the retraction device are drivable by an electric motor assembly with one common electric motor for driving both the ejection device and the retraction device. This embodiment has the advantage that only a single electric motor is required per drive.

The operation of switching over the transmission of force from the electric motor to the ejection lever of the ejection device or to the roller of the retraction device respectively can be effected by a wide range of different couplings. A particularly preferred embodiment, however, is one in which the transmission of force from the electric motor is effected selectively to the ejection lever or the roller by way of a planetary transmission. A planetary transmission of that kind is distinguished by a particularly compact structure, which is of significance in particular when the ejection device and the retraction device are arranged in a common housing.

In this embodiment, the planetary transmission is of a two-stage nature, wherein the one stage serves for the transmission of force from the electric motor to the ejection lever, and the second stage serves for the transmission of force from the electric motor to the roller. Selection of the respective stage can be effected by way of a brake which is switchable by a control or regulating device and which, for example, can be in the form of a solenoid brake.

Each of the two stages of the planetary transmission can have its own hollow ring gear in which the respective planetary gears are accommodated. The brake of each stage cooperates with the respective ring gear. Fixing the respective ring gear by the respective brake causes a rotational movement of the planetary gears.

In an embodiment of the invention, in the stage associated with the ejection unit, the transmission of force is effected with the planetary gears rotating. In the stage associated with the roller, the transmission of force occurs with the planetary gears stationary. That arrangement provides that the mutually opposite directions of rotation of the ejection lever and the roller can be implemented with the same direction of rotation of the electric motor.

By way of example, three planetary gears can be provided for each stage.

The sun gear of the planetary transmission is formed in each stage by a common shaft drivable by the common electric motor.

As already stated a common control or regulating device for controlling or regulating the ejection device and the retraction device can be provided in each of the above-mentioned embodiments.

In each embodiment of the drive, the ejection device can have a touch-latch functionality. That means that the ejection device is triggerable in the closed and/or partially or completely opened end position of the movable furniture part, by an application of force to the furniture part. The configuration of the ejection device, that is necessary for that purpose, was already disclosed in Austrian patent AT 413 472 (see in particular page 4, paragraphs 3 through 7; page 7, paragraphs 4 and 5; page 8, paragraph 6 and the Figures referred to therein) so that there is no need for a more detailed description at this juncture.

The retraction device can also be provided with such a touch-latch functionality so that overall this provides a drive having a touch-latch functionality. For that purpose, it is necessary for the roller to be biased in the winding-on direction by a force storage means so that the pulling means is constantly held under a mechanical tension in the retraction direction. By virtue of that arrangement, an application of force to the movable furniture part by a user can be transmitted to the roller by way of the pulling means and can be detected by way of suitable means (for example rotary potentiometers).

BRIEF DESCRIPTION OF THE DRAWINGS

Further advantages and details of the invention will be apparent with reference to the drawings and the related specific description. In the drawings.

DETAILED DESCRIPTION OF THE INVENTION

Figure 1:
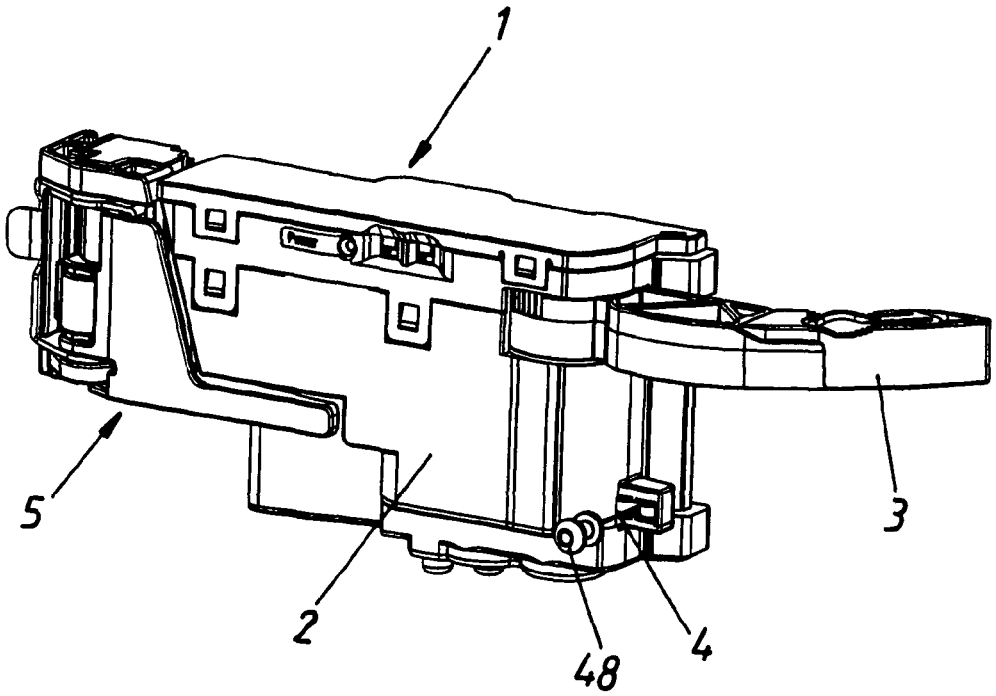
FIG. 1 shows a perspective view of an embodiment of a drive according to the invention with a common housing.

FIG. 1 shows a perspective view of a drive 1 according to the invention in which all components are arranged in a common housing 2 or mounted therein. It is possible to see in particular the ejection lever 3 of an ejection device and the pulling member 4 of a retraction device. The drive 1 can be fastened without a tool to a profile bar (not shown) in a furniture body or carcass by way of the lever mechanism denoted by reference 5.

Figure 2A:
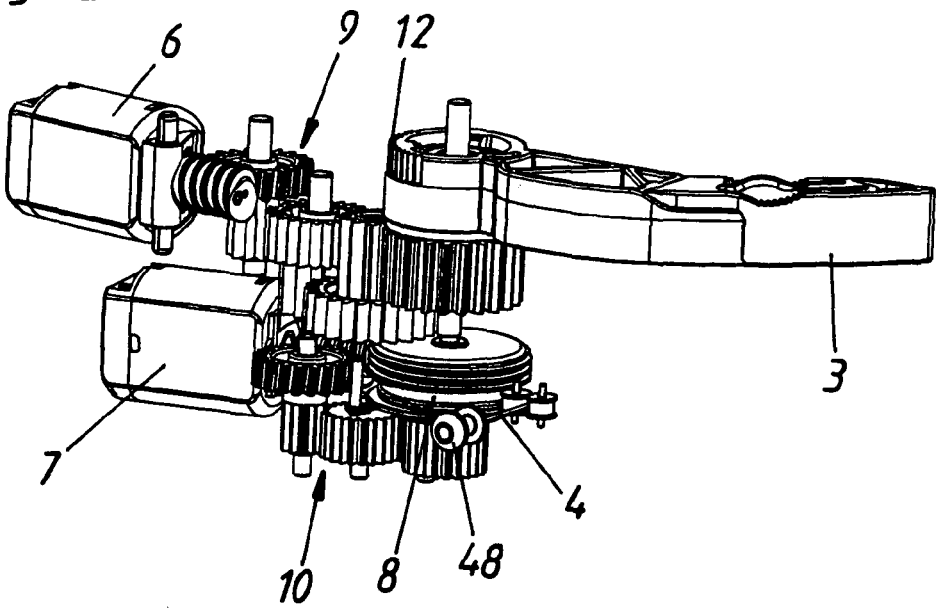
FIGS. 2*a* and 2*b* show the drive train of a first embodiment of a drive according to the invention as a perspective view and a block-wise exploded view.

FIG. 2*a* shows a perspective view of the first drive train 6, 9, 3 of the ejection device and the second drive train 7, 10, 8 of the retraction device for a first embodiment of a drive 1 according to the invention, in which the ejection lever 3 of the ejection device and the roller 8 of the retraction device are drivable by an electric motor assembly with separate electric motors 6 and 7 respectively, and there are respective dedicated transmissions 9 and 10 for the transmission of force.

The first drive train 6, 9, 3 of the ejection device has a first transmission 9 by which the rotary speed of the electric motor 6 (for example about 6000 rpm) can be reduced by way of a series of gears. It can further be seen that the ejection lever 3 is provided in a known manner (see for example FIG. 17 of AT 413 472 B) with a tooth configuration 12 with which a rotary potentiometer (not shown) meshes to ensure a touch-latch functionality.

Figure 3A:
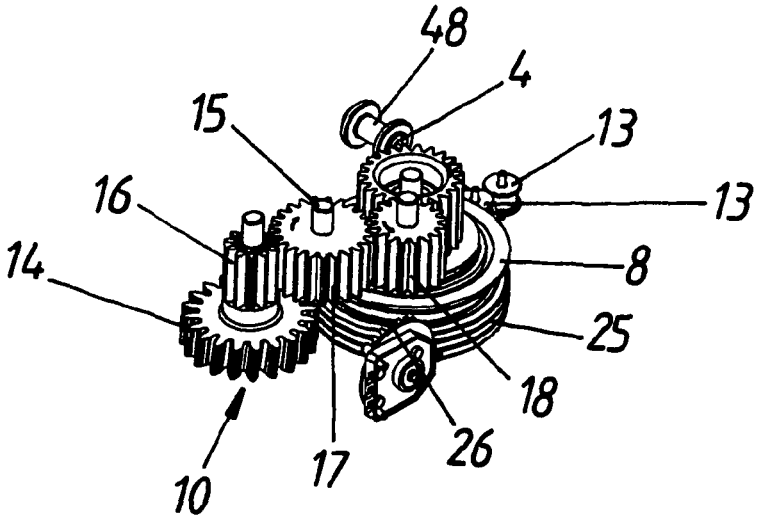
FIGS. 3*a* and 3*b* show a detail view of FIGS. 2*a* and 2*b* as a perspective view and an exploded view.
Figure 3B:
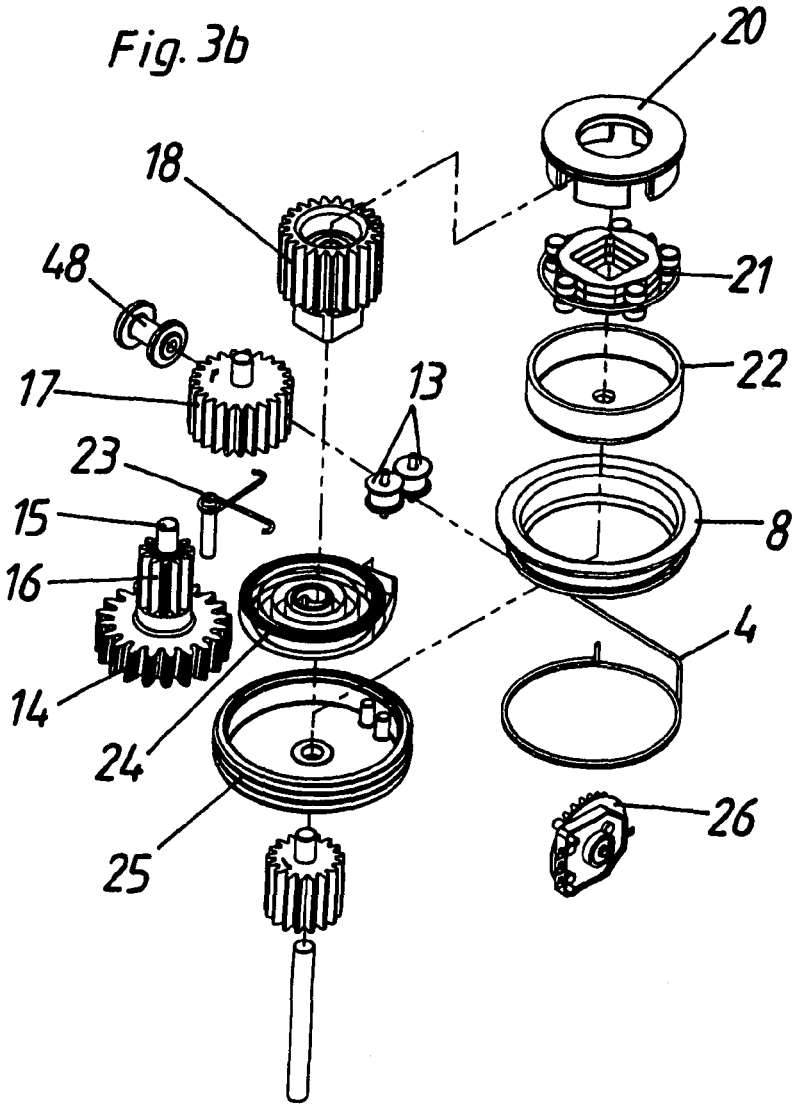

The second drive train 7, 10, 8 of the retraction device has a second transmission 10 for reducing (about 40:1) the rotary speed of the second electric motor 7 (for example, about 12,000 rpm) and is shown in detail in FIGS. 3*a* and 3*b*.

Figure 2B:
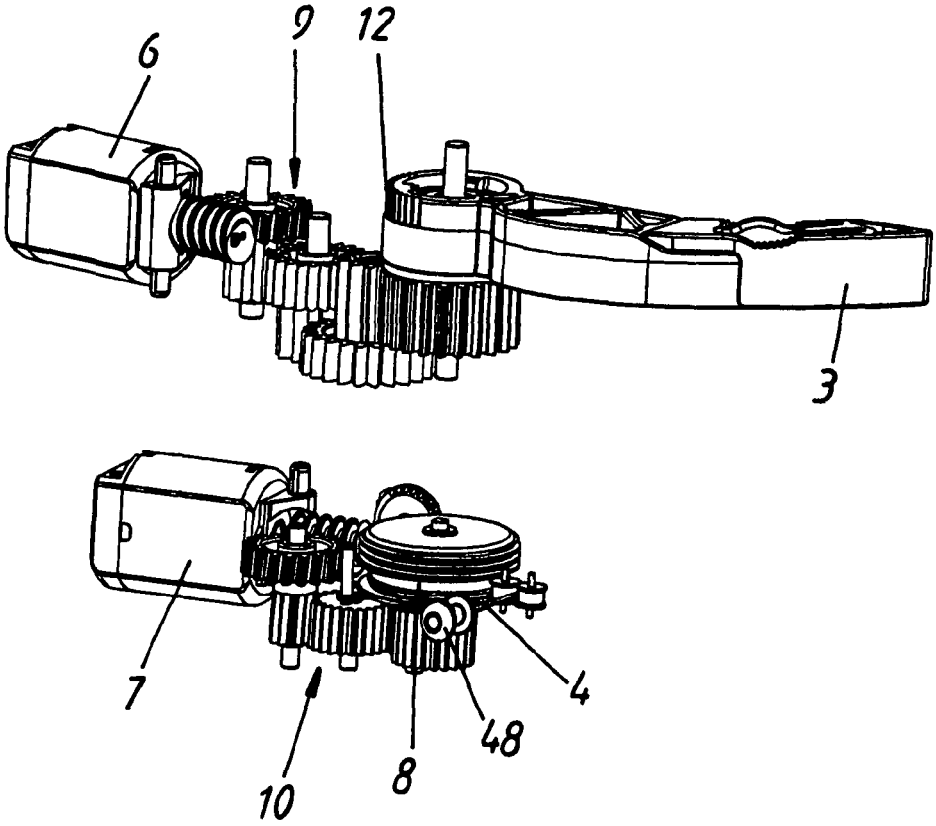

FIG. 2*b* shows that the first and second drive trains 6, 9, 3 and 7, 10, 8 in the mounted position shown in FIG. 2*a* are mechanically separated from each other and are pushed as close together as possible only for reasons of space.

FIG. 3*a* shows the second transmission 10 together with the roller 8 which is driven by the second transmission 10 and on which the pulling member 4 is wound. The pulling member 4 is passed out of the housing 2 (not shown here) by rollers 13 and is provided at its free end with a coupling portion 48 to be connected to a corresponding coupling portion (not shown) on the movable furniture part.

The second electric motor 7 drives the gear 14 by way of its worm. The gear 14 is non-rotatably connected by the shaft 15 to the gear 16. The gear 16 meshes with the gear 17 which in turn meshes with the gear 18. The gear 18 is non-rotatably connected to a square region 19 serving for the transmission of force to the roller 8. In this arrangement, connected between the square region 19 and the roller 8 is a slipping clutch 20 through 23 which is described in detail in Austrian patent application A 1769/2006. This involves a wrap spring clutch, the outer casing 22 of which is slightly braked by the spring 23, leading to immediate shifting of the clutch.

The roller 8 is biased in the winding-on direction by a force storage means 24.

Non-rotatably connected to the roller 8 is a worm attachment 25 meshing with the drive gear 26 of a rotary potentiometer. In that case, the rotary potentiometer serves to determine the position of the roller 8 to implement a touch-latch functionality and the position as a movable furniture part.

FIGS. 4*a* through 4*e* show the drive train of a second embodiment of a drive 1 according to the invention, including an electric motor assembly with a common (single) electric motor 6 for driving both the ejection lever 3 and the roller 8 (see FIG. 5).

Figure 4A:
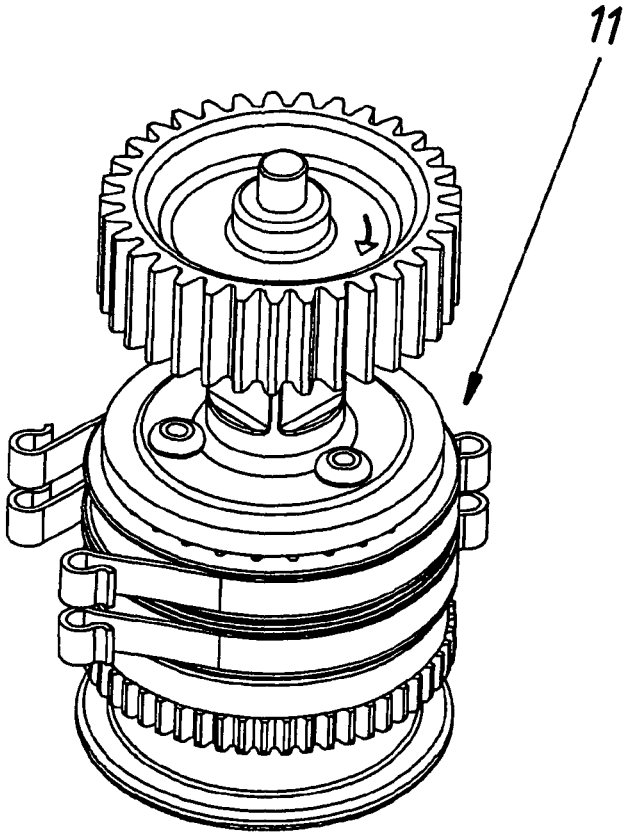
FIGS. 4*a* through 4*e* show the drive train of a second embodiment of a drive according to the invention in various perspective views and sectional views.
Figure 4B:
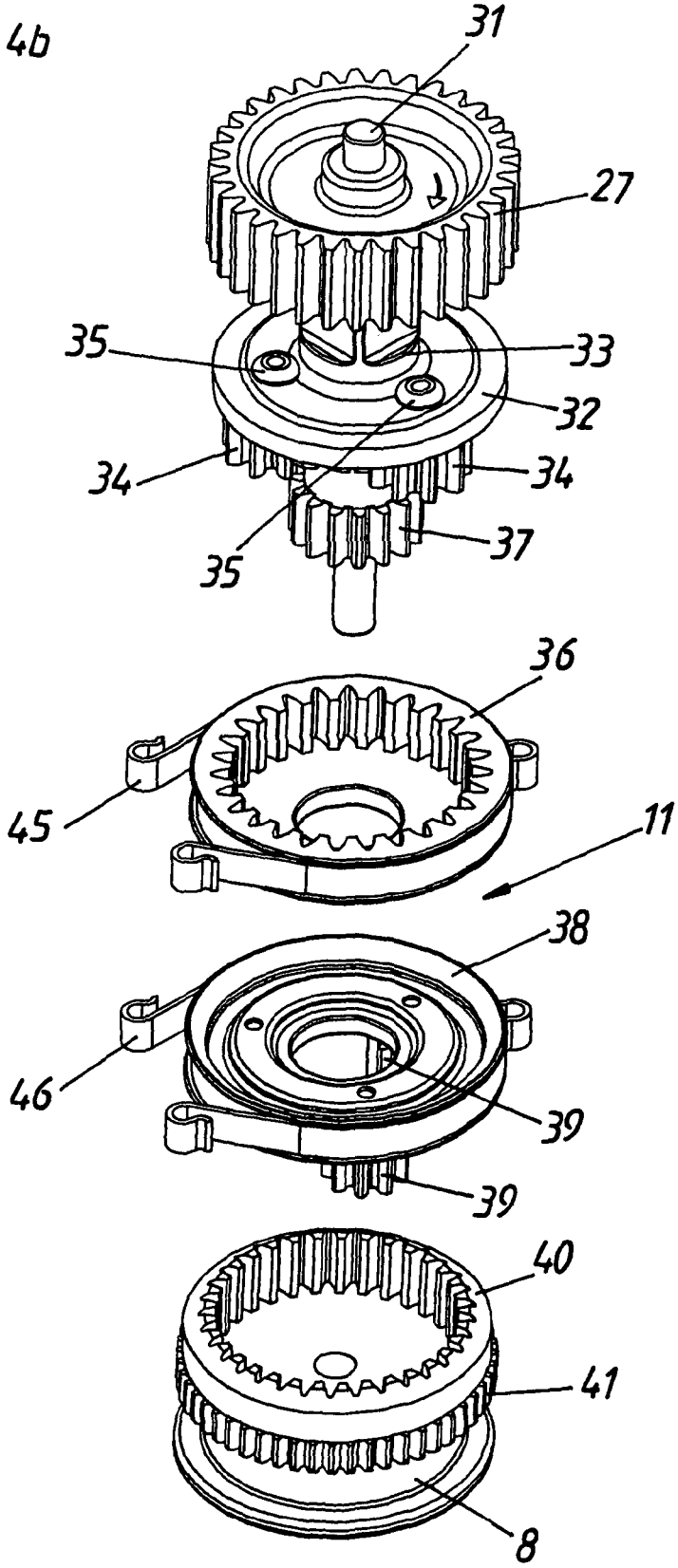

In this case, a planetary transmission 11 is provided for the selective transmission of force to the ejection lever 3 of the ejection device and the roller 8 of the retraction device respectively (see the perspective view in FIG. 4*a*). The structure of the planetary transmission 11 will be described with reference to FIG. 4*b* in conjunction with FIGS. 5*a* through 5*c*. The flow of force through the planetary transmission 11 is diagrammatically shown in FIGS. 4*c* through 4*e*.

Figure 5A:
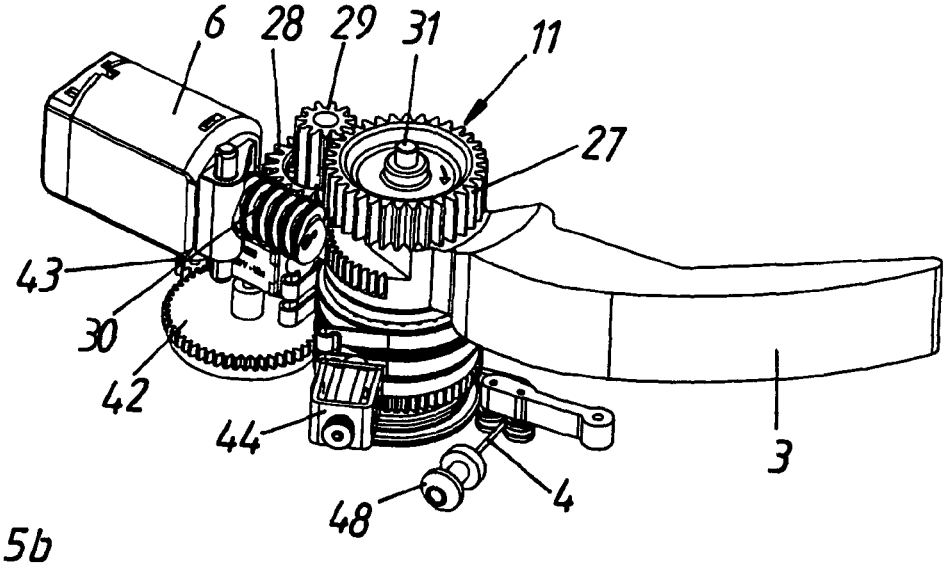
FIGS. 5*a* through 5*c* show the drive train illustrated in FIGS. 4*a* through 4*c* in further views and as a detail view.

The planetary transmission 11 has a first drive gear 27 drivable by way of the gears 28 and 29 by the worm 30 of an electric motor 6 (see FIG. 5*a*).

The drive gear 27 is arranged non-rotatably on the shaft 31 which functions as the sun gear of the planetary transmission 11. Arranged on the same shaft 31 is a gear carrier 32 which by way of pins 35 carries three planetary gears 34 (only two planetary gears 34 can be seen in FIG. 4*b*). Arranged integrally with the gear carrier 32 between the gear carrier 32 and the first drive gear 27 is a square region 33, on to which the ejection lever 3 of the ejection device can be fitted for drive purposes. Jointly with a ring gear 36 which is toothed at the inside (i.e., has internal teeth), the first stage of the planetary transmission 11 is formed by the components 32, 33, 34, 35 and 36 and the shaft 31 as the sun gear.

Arranged beneath the first ring gear 36 is a second ring gear 38 carrying three planetary gears 39 (only two can be seen). The planetary gears 39 mesh with the internal teeth of a roller gear 40 which is formed integrally with the roller 8 and with the intermediate gear 37 non-rotatably connected to the shaft 31. The roller gear 40 further has external teeth 41 which mesh by way of a gear 42 and a gear 43 with a rotary potentiometer (not shown) (see FIG. 5*a*).

The second stage of the planetary transmission 11 is formed by the components 37, 38, 39 and 40 and the shaft 31 as the sun gear.

Figure 4D:
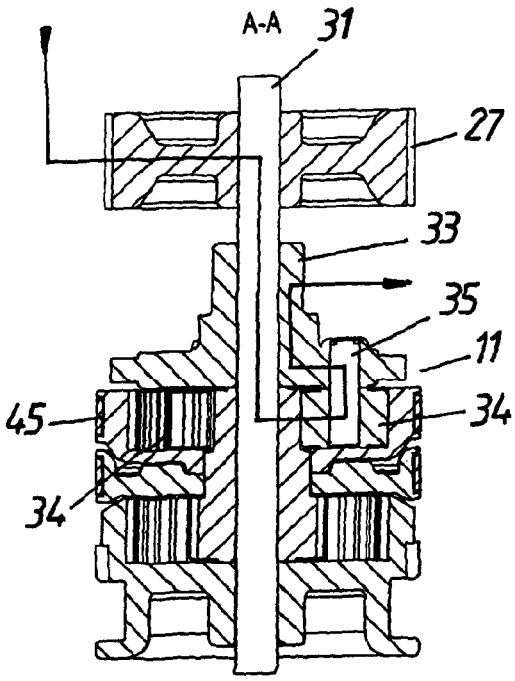
Figure 4E:
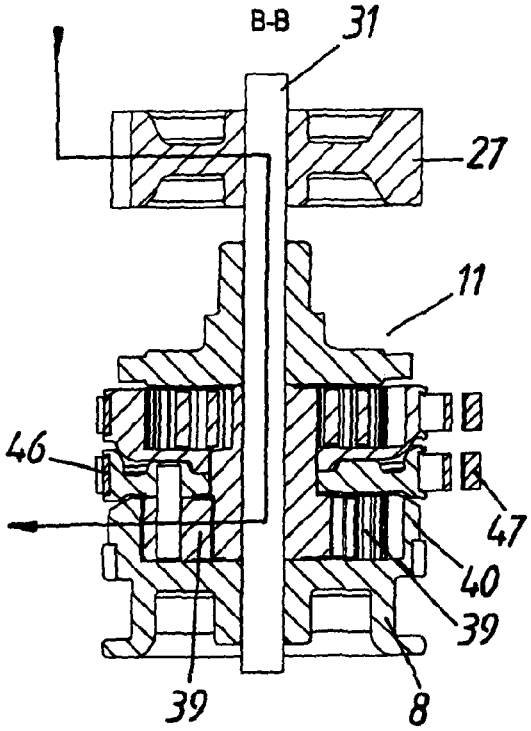
Figure 4C:
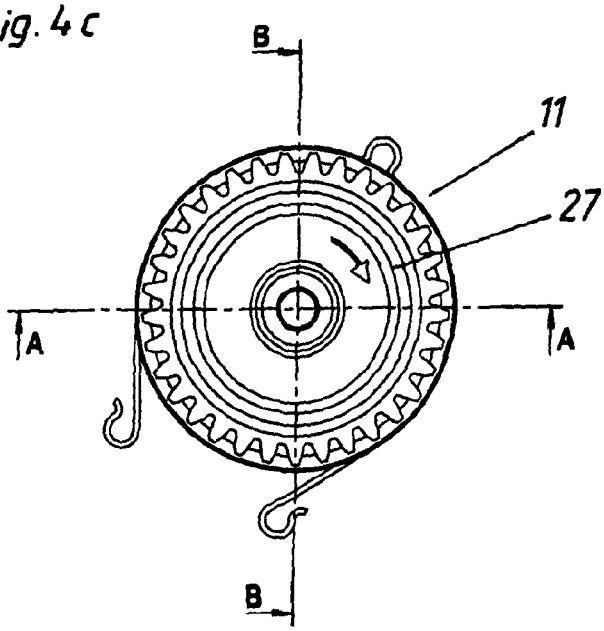

The functionality of the planetary transmission 11 will also be described in particular with reference to FIGS. 4*c* through 4*e*. In this respect, for the sake of enhanced clarity, only the respective relevant components are denoted by reference numerals in FIGS. 4*d* and 4*e*.

FIG. 4*d* shows the transmission of force from the electric motor 6 to the ejection lever 3 of the ejection device. The application of force is effected by way of the drive gear 27 to the shaft 31. The brake 44 associated with the first stage of the planetary transmission 11 (this cannot be seen in FIG. 4*d* as it is on the rear side which cannot be viewed) brakes the first ring gear 36 of the first stage by way of a first wrap spring 45. That causes a rotational movement of the planetary gears 34 in the first ring gear 36, in meshing engagement with the internal teeth of first ring gear 36. That arrangement provides that, by way of the pins 35, the gear carrier 32 and the square region 33 arranged thereon are rotated. That rotation drives the ejection lever 3 of the ejection device.

In the meantime, the brake 44 of the second stage remains inactive. The second ring gear 38 of the second stage can freely rotate jointly with the planetary gears 39 fixed thereto. By virtue of that situation, no force is transmitted to the roller gear 40 and the roller 8.

The situation is different in FIG. 4*e*. Here the brake 44 (see FIG. 5*a*) of the second stage is active and presses the second wrap spring 46 against the second ring gear 38. Due to second the ring gear 38 being fixed, the planetary gears 39 remain stationary and mesh on the one hand with the intermediate gear 37 driven by the shaft 31 and on the other hand with the internal teeth of the roller gear 40. As a result, the drive force is transmitted from the intermediate gear 37 (sun gear) by way of the planetary gears 39 to the roller gear 40 and thus to the roller 8.

The first stage (transmission of force to the ejection lever 3) therefore has a first set of planetary gears 34 which rotate during the transmission of force whereby the gear carrier 32 carrying the planetary gears 34 by way of the pins 35 is set in motion.

In contrast thereto, the second stage (for the roller 8) has a second set of planetary gears 39 which are stationary during the transmission of force as in fact the second ring gear 38 on which the planetary gears 39 are mounted is fixed by the wrap spring 46. That situation involves the transmission of force from the shaft 31 and the gear 37 by way of the planetary gears 39 to the gear 40. The direction of rotation, however, is reversed in comparison with the first stage. That is also to be required as in fact the drive direction for ejection or retraction respectively of a movable furniture part must be in mutually opposite relationship, while the direction of rotation of the shaft 31 is unchanged.

Figure 5B:
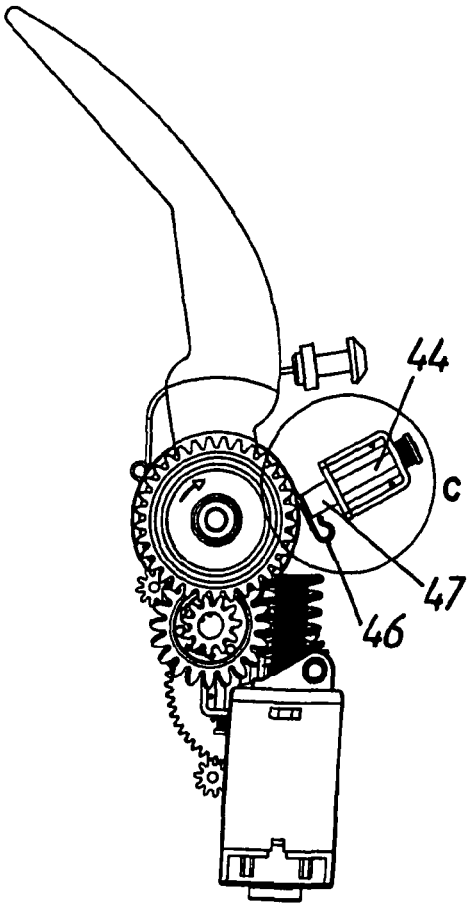
Figure 5C:
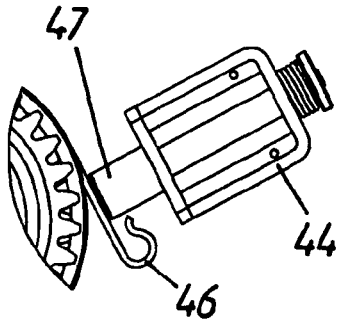

The structure of the brake 44 is also of interest, as can be seen from FIGS. 5*b* and 5*c*. It can be seen that the brake 44 has a pushrod 47 which, when the brake 44 is activated, presses against the associated wrap spring 45 or 46, respectively. In this embodiment, the brakes 44 are in the form of solenoid brakes.

The invention claimed is:

1. A drive device for moving a movable furniture part relative to a furniture body, comprising:

an ejection device including an ejection lever which ejects the movable furniture part;

a retraction device including a pulling member wound onto a roller which retracts the movable furniture part; and an electric motor assembly which drives said ejection lever of said ejection device and said roller of said retraction device;

wherein said ejection device and said retraction device are mechanically connected so that they are mounted as a unit in or on the furniture body.

2. The drive device of claim 1, further comprising a force storage means for biasing said roller in a winding-on direction.

3. The drive device of claim 1, further comprising a common control for controlling said ejection device and said retraction device.

4. The drive device of claim 1, further comprising a common housing in which said ejection device and said retraction device are arranged.

5. The drive device of claim 4, wherein said housing has a stirrup arrestable by a fastening lever for fastening said drive device to a profile bar without a tool.

6. The drive device of claim 1, wherein said electric motor assembly includes a pair of dedicated electric motors each configured to drive a respective one of said ejection device and said retraction device.

7. The drive device of claim 6, further comprising a pair of dedicated transmissions each configured to transmit force from one of said dedicated electric motors to a respective one of said ejection lever and said roller.

8. The drive device of claim 1, wherein said electric motor assembly includes one common electric motor for driving both said ejection lever of said ejection device and said roller of said retraction device.

9. The drive device of claim 8, further comprising a planetary transmission configured to selectively and changeably transmit force from said common electric motor to a selected one of said ejection lever and said roller.

10. The drive device of claim 9, wherein said planetary transmission is a two-stage planetary transmission, including a first stage for selectively transmitting force from said common electric motor to said ejection lever, and a second stage for selectively transmitting force from said common electric motor to said roller.

11. The drive device of claim 10, wherein each of said first stage and said second stage includes a respective brake for effecting transmission of force to a respective one of said first stage or said second stage upon actuation of said respective brake.

12. The drive device of claim 11, wherein each of said first stage and said second stage has a ring gear in which respective planetary gears are accommodated, wherein said respective brake of each of said first stage and said second stage cooperates with said ring gear of a respective one of said first stage or said second stage.

13. The drive device of claim 12, wherein said first stage is associated with said ejection device, and said first stage is configured to transmit force while said planetary gears rotate, said second stage is associated with said retraction device, and said second stage is configured to transmit force while said planetary gears remain stationary.

* * * * *